US009751729B2

(12) United States Patent
Gonzalez Alemany et al.

(10) Patent No.: US 9,751,729 B2
(45) Date of Patent: Sep. 5, 2017

(54) VARYING SPEED TRANSPORTATION SYSTEM

(71) Applicant: THYSSENKRUPP ELEVATOR INNOVATION CENTER S.A., Gijon (ES)

(72) Inventors: Miguel Angel Gonzalez Alemany, Oviedo (ES); Juan Domingo Gonzalez Pantiga, Gijon (ES); Alberto Florez Castro, Lugo de Llanera (ES); Luis Joaquín Fernandez Alvarez, Gijon (ES); Enrique Gonzalez Fernandez, Gijon (ES); José Mendiolagoitia Juliana, Gijon (ES); Alberto Pello Garcia, Piedras Blancas (ES); José Ojeda Arenas, Gijon (ES); Eduardo Moran Garcia, Gijon (ES); Ana Belén Quiroga Sanchez, Oviedo (ES); Ignacio Muslera Fernandez, Gijon (ES)

(73) Assignee: THYSSENKRUPP ELEVATOR INNOVATION CENTER S.A., Gijon (ES)

( * ) Notice: Subject to any disclaimer, the term of this patent is extended or adjusted under 35 U.S.C. 154(b) by 0 days.

(21) Appl. No.: 15/024,480

(22) PCT Filed: Aug. 19, 2014

(86) PCT No.: PCT/ES2014/070662

§ 371 (c)(1),
(2) Date: Mar. 24, 2016

(87) PCT Pub. No.: WO2015/044481

PCT Pub. Date: Apr. 2, 2015

(65) Prior Publication Data

US 2016/0221797 A1 Aug. 4, 2016

(30) Foreign Application Priority Data

Sep. 25, 2013 (ES) ..... 201331396

(51) Int. Cl.
*B66B 23/26* (2006.01)
*B66B 23/02* (2006.01)
*B66B 21/12* (2006.01)

(52) U.S. Cl.
CPC ..... *B66B 23/02* (2013.01); *B66B 21/12* (2013.01); *B66B 23/26* (2013.01)

(58) Field of Classification Search
CPC ..... B66B 23/26; B66B 21/12
(Continued)

(56) References Cited

U.S. PATENT DOCUMENTS 935,631 A 10/1909 Adkins et al.
3,842,961 A * 10/1974 Burson ..... B66B 23/26 104/167
(Continued)

FOREIGN PATENT DOCUMENTS

CA 2762997 A1 6/2013
CN 1140979 A 1/1997
(Continued)

OTHER PUBLICATIONS

English Translation of International Search Report for PCT/ES2014/070662 dated Nov. 28, 2014 (mailing date Dec. 5, 2014).
(Continued)

*Primary Examiner* — James R Bidwell
(74) *Attorney, Agent, or Firm* — thyssenkrupp North America, Inc.

(57) ABSTRACT

An example drive system for a transportation system may include an actuator for transmitting an actuation motion from a motor, a first pulling device configured to transmit a
(Continued)

pulling motion from the actuator to moving parts of the transportation system in a transition speed section situated between an embarking/disembarking zone and a middle zone, a second pulling device configured to transmit a pulling motion from the first pulling device to the moving parts of the transportation system in a high-speed section in a middle zone of the transportation system. In some examples, the first pulling device may be a carriage.

9 Claims, 6 Drawing Sheets

(58) Field of Classification Search
USPC ..... 198/334, 335, 661
See application file for complete search history.

(56) References Cited

U.S. PATENT DOCUMENTS 4,440,038 A * 4/1984 Potter ..... F16H 25/2261 74/424.93
4,509,429 A * 4/1985 de Broqueville ..... B61B 9/00 198/334
4,567,979 A 2/1986 Hoehn
5,878,865 A 3/1999 Bailey et al.
6,170,632 B1 1/2001 Shimura et al.
6,479,660 B1 11/2002 Ugwuegbulam et al.
6,796,416 B2 9/2004 Ogura et al.
2002/0126696 A1 9/2002 Toguchi et al.
2010/0000843 A1 1/2010 Nishikawa et al.
2010/0089718 A1* 4/2010 Gonzalez Alemany ..... B66B 23/04 198/334

FOREIGN PATENT DOCUMENTS

CN 1147475 A 4/1997
CN 201458502 U 5/2010
EP 0909737 A2 4/1999
ES 2272118 A1 4/2007
ES 2289955 A1 2/2008
GB 1383785 A 2/1974
GB 2300168 A 10/1996

OTHER PUBLICATIONS

Priority Search Document from the Oficina Española de Patentes y Marcas (dated Mar. 27, 2014).
English Language Abstract for ES2289955.
English Abstract of CN201458502U.

* cited by examiner

VARYING SPEED TRANSPORTATION SYSTEM

CROSS REFERENCE TO RELATED APPLICATIONS

This application is a U.S. National Stage Entry of International Patent Application Serial Number PCT/ES2014/070662, filed Aug. 19, 2014, which claims priority to Spanish Patent Application No. ES P201331396 filed Sep. 25, 2013, the entire contents of both of which are incorporated herein by reference.

FIELD

The present disclosure relates to transportation systems for moving passengers and/or goods and, more particularly, to drive systems for such transportation systems that have different sections moving at different speeds.

BACKGROUND

It is common to find mechanical walkways wherein several sections have been defined, acting at different speeds such that, depending on which way it runs, the walkway establishes a first embarking zone that has a slow speed, an acceleration zone, an intermediate zone at the maximum speed, a deceleration zone, and a disembarking zone at slow speed.

In order to obtain the variable speed required in the acceleration and deceleration zones, there are different solutions, one of which is identified in document ES2289955. Said document describes an acceleration walkway with a moving surface made up of assemblies of plates, each of which is formed by a pulled plate and a pulling plate, hinged to one another along an axis that is perpendicular to the travel direction. The walkway includes embarking and disembarking zones in which the plates circulate at a slow speed, a central zone in which the plates circulate at a fast speed, and two transition zones in which the plates accelerate and decelerate by using different pulling systems for each one of the zones. In the system described in said document ES2289955, power is transmitted through a chain of rollers, and the screw is only in charge of altering the speed of the pallets, but never transmits power to the carriages that push the pallets.

DETAILED DESCRIPTION

Figure 1:
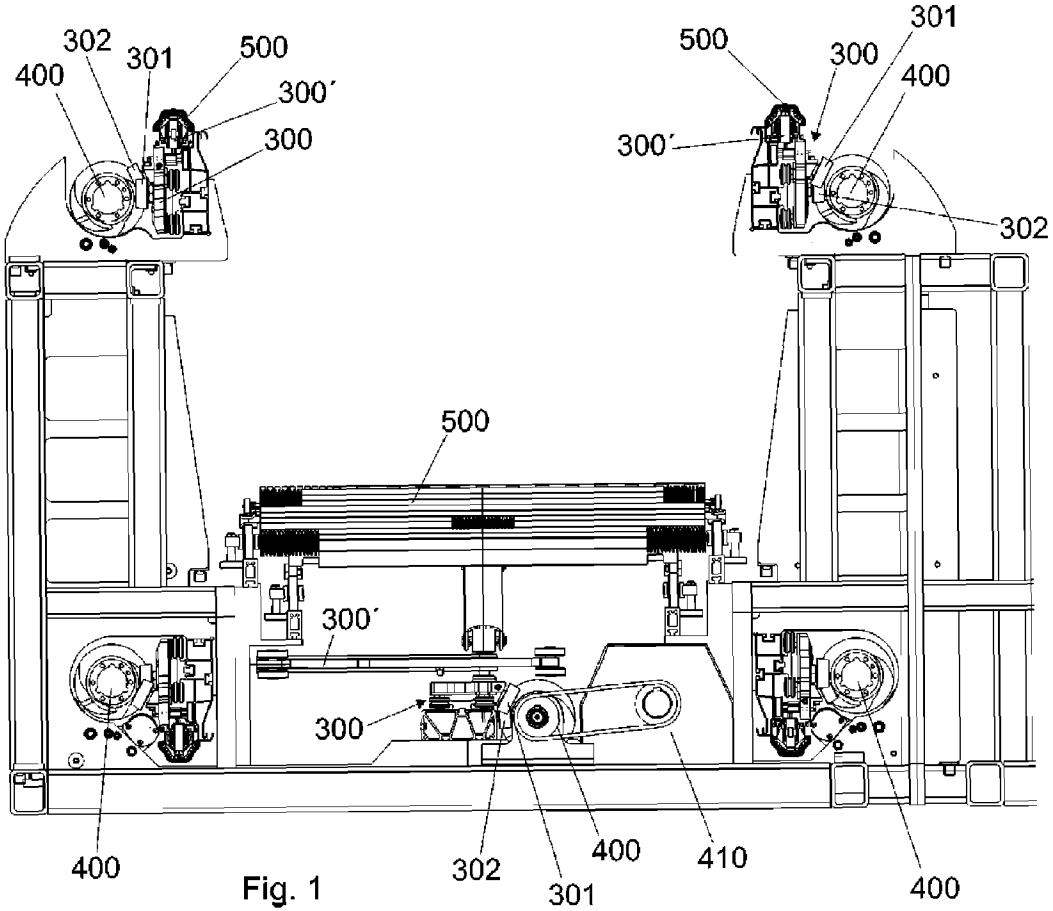
FIG. 1 is a side view of example handrail acceleration screws, example handrail drive screws, and an example pallet drive/acceleration screw.
Figure 2:
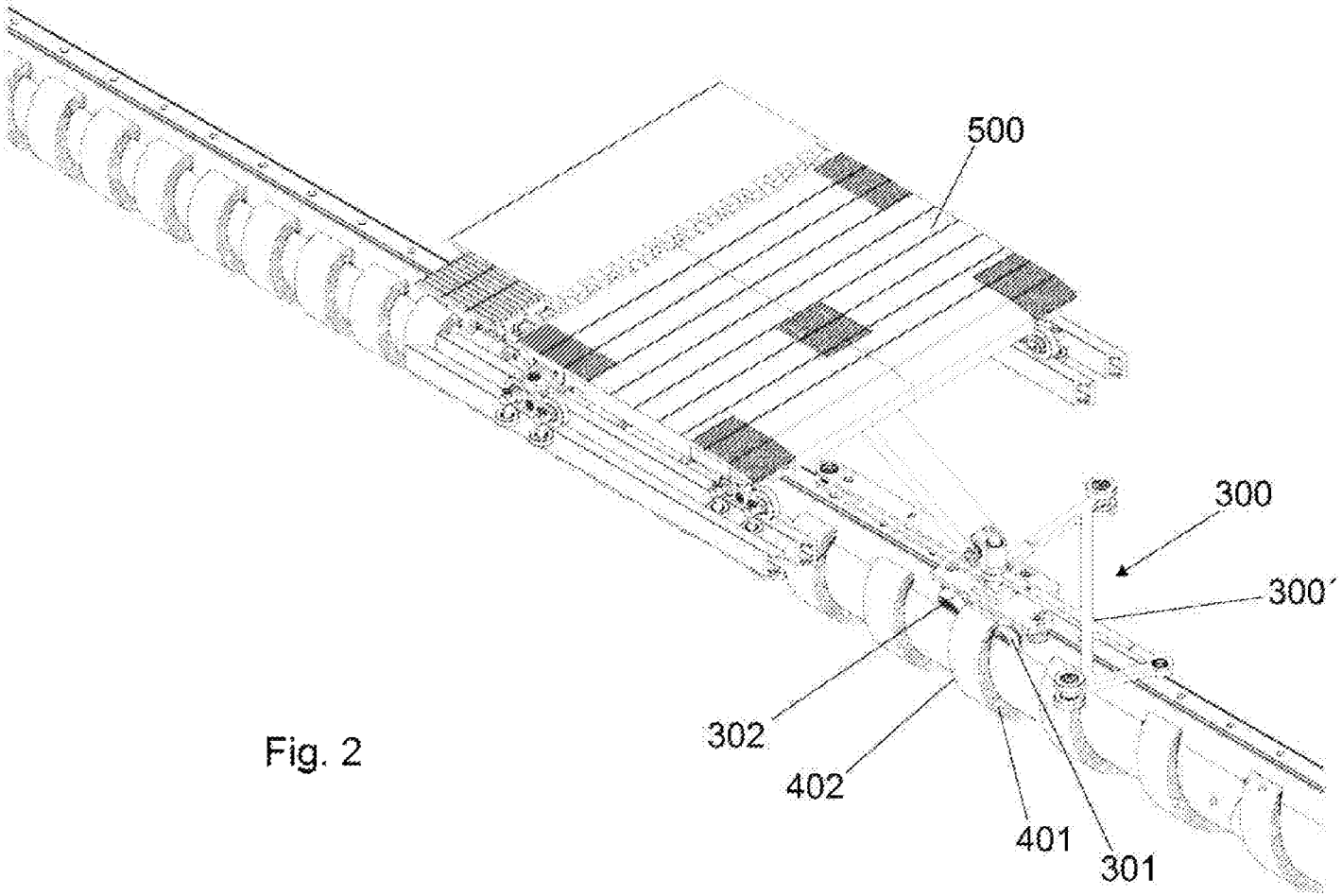
FIG. 2 is a perspective view of an example actuation means and an example pulling means of an example pallet system.
Figure 3:
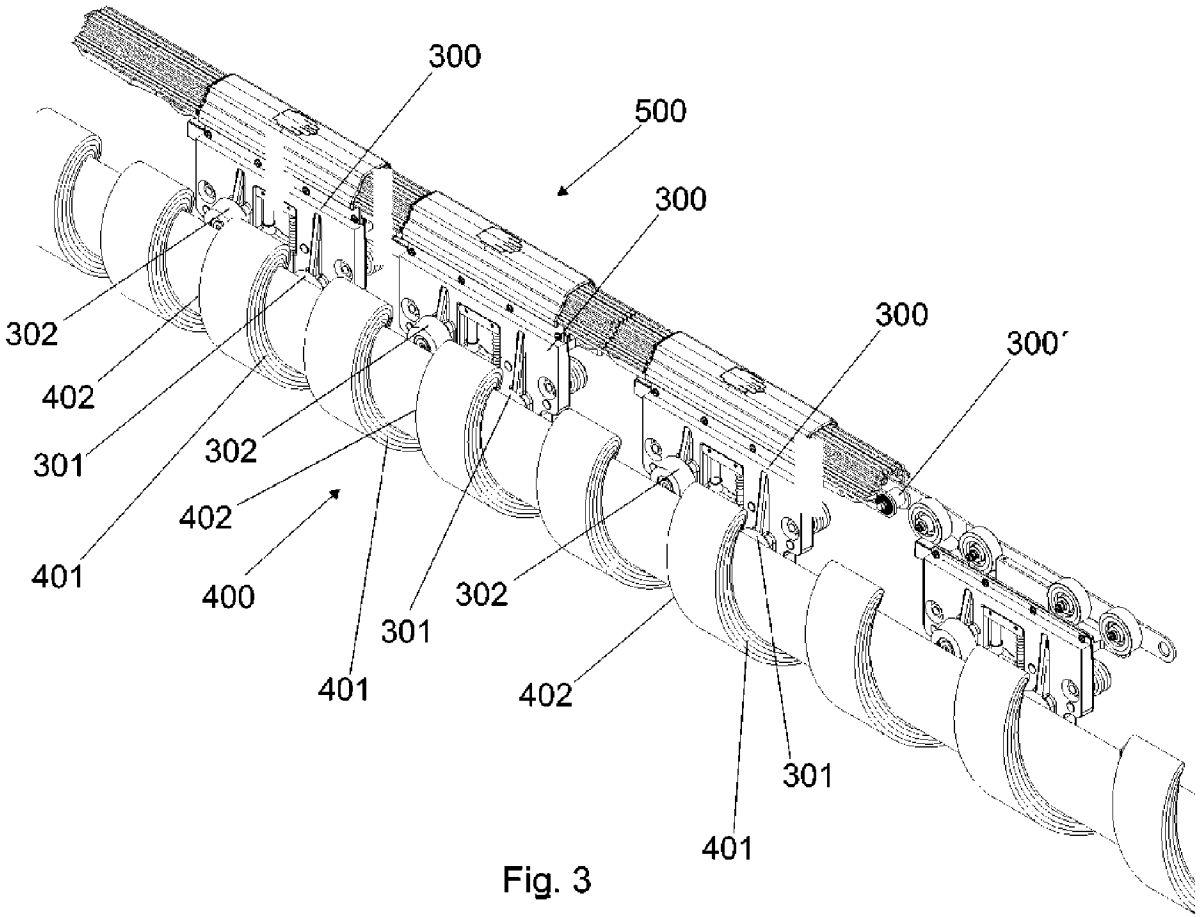
FIG. 3 is a perspective view of an example actuation means and an example pulling means of an example handrail system.
Figure 4:
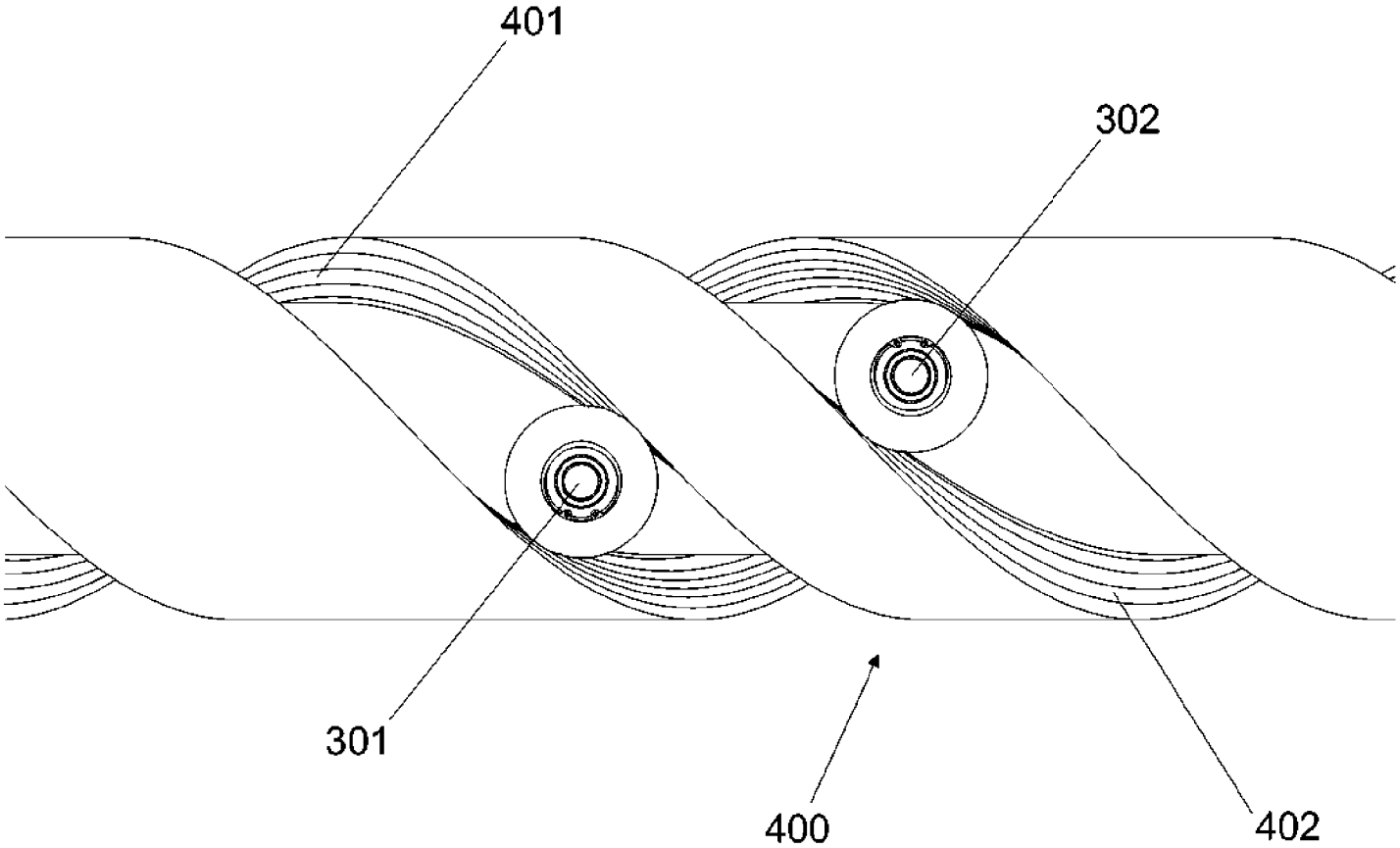
FIG. 4 is a side view of an example arrangement of example helices on a screw of an example actuation means with respective rollers, which may be configured for a pallet and handrail system of a walkway.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns drive systems for transportation systems for moving passengers and/or goods. Many of these transportation systems may have a high-speed section situated in a middle zone and transition speed sections situated between the middle zone and embarking/disembarking zones. The present disclosure therefore applies to, for example and without limitation, mechanical walkways of the sort used in airports, bus stations, train stations, and generally all large-scale premises in which users must traverse long distances and/or where there is an aim to facilitate this type of movement.

Thus, at a high level, some examples of the present disclosure may be said generally to comprise two parts, namely an actuator, or actuation means, and a pulling means.

The actuation means 400 consist of a variable-pitch worm shaft or screw 400, whereas the pulling means are formed by a supporting carriage 300 provided with a drive roller 301, and a driven roller 302, and a chain joined thereto, the nature of which may vary depending on its use or application.

As for the variable pitch worm shaft, or screw 400, of the actuation means, it consists of a double helix, such that one of the helices, the first helix 401, acts as a guide for the drive roller 301 of the supporting carriage 300, and the other of the helices, the second helix 402, acts as a guide for the driven roller 302.

In terms of the supporting carriage, as mentioned above, it is formed by at least two rollers 301, 302. The drive roller 301 engages with the screw 400 or worm shaft, whereas the other roller, the driven roller 302, ensures proper positioning of the contact between the carriage 300 and the screw 400.

The configuration of the carriage rollers has been designed in order to optimise contact between the helix of the screw and the drive roller, for the purpose of avoiding the occurrence of the sliding effect which could arise at top speed between the drive roller and the screw.

Specifically, the invention relates to a system like that which is defined in the set of claims.

This is to say, the invention relates to a drive system for a transport system which has actuation means to transmit an actuation motion from at least one motor, and first pulling means configured to transmit a pulling motion from the actuation means to each one of the moving parts that form the transport system in a transition speed section situated between an embarking/disembarking zone and a middle zone.

The moving parts may refer to pallets that form a ramp of a transport system which in succession give rise to a variable speed continuous passenger transport system.

Likewise, the moving parts may also refer to grips, which in succession constitute a variable speed continuous handrail placed on both sides and at a higher elevation of the variable speed continuous passenger transport system, providing a hold that is synchronised with the movement of the pallets of said system.

These first pulling means are also configured to drive second pulling means, which transmit a pulling motion from the first pulling means to each one of the moving parts (pallets or handrail) that form the transport system in a high-speed section situated in a middle zone of the transport system.

The actuation means consist of a screw 400 that has a constant pitch in the high-speed zones and a variable pitch in the transition speed zones. This screw 400 transmits the motion of the first pulling means 300 by means of a first helix 401 that engages with a drive roller 301 of the first pulling means 300, with a variable radius, and prevents there being looseness between the two by means of a second helix 402 that engages with a driven roller 302 of the first pulling means 300, with a variable radius.

In order to improve the contact with the surface of the screw 400, both the drive roller 301 and the driven roller 302 have a variable radius.

One embodiment of the invention relates to a drive system for a transport system which has actuation means 400 to transmit an actuation motion from at least one motor 410. Moreover, the system has first pulling means 300 configured to transmit a pulling motion from the actuation means 400 to each one of the moving parts 500 (pallets or handrail) of the transport system in a transition speed section situated between an embarking/disembarking zone and a middle zone. In addition, the system has second pulling means 300' configured to transmit a pulling motion from the first pulling means 300 to the moving parts 500 (pallets or handrail) of the transport system in a high-speed section situated in a middle zone of the transport system.

Specifically, the actuation means 400 are variable pitch worm shafts, or screws 400, which engage with the first pulling means 300, which constitute a plurality of supporting carriages 300, upon which a chain is mounted that joins together the various pallets 500, which are the second pulling means 300', transmitting power over the whole path, and upon which the band of pallets 500 is in turn situated.

In addition, in the system there are other independent variable pitch worm shafts or screws 400, which are synchronised with the previous ones (the screws 400 that actuate the pallets 500). These additional screws 400 actuate the handrails 500, both that of the user's right hand side and that of the left hand side.

The screws 400 transmit the power needed in order to move a series of supporting carriages 300, altering their speed, and upon which a chain circulates at a constant speed 300' (second pulling means), with which said carriages 300 engage, transmitting power, or disengage, thus altering the speed thereof without transmitting power, depending on the zone of the walkway where it is located.

Thus, the motion between the first pulling means 300 and the actuation means 400 is transmitted by means of drive rollers 301 of the pulling means 300 which engage with a first helix 401 with a special geometry on the screw of the actuation means 400. Said geometry enables complete engagement in the contact between the first helix 401 and the drive rollers 301, preventing any relative movement that would produce noise, wear and unnecessary loss of efficiency.

Figure 5:
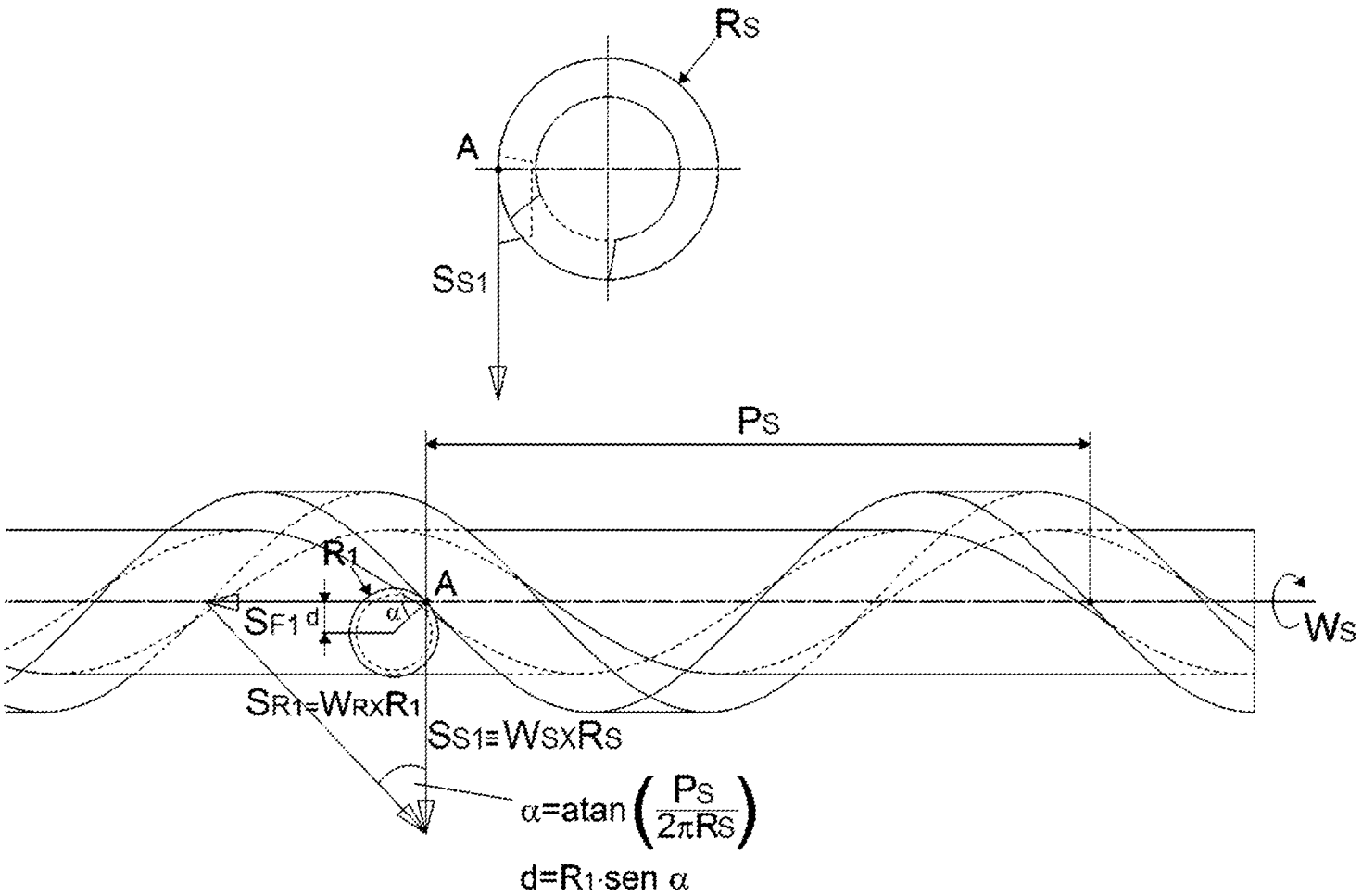
FIG. 5 is a side view of example contact between example drive rollers and example pulling helices in an area thereof that is furthest from an axis of a screw, with relative speeds deriving from the contact.
Figure 6:
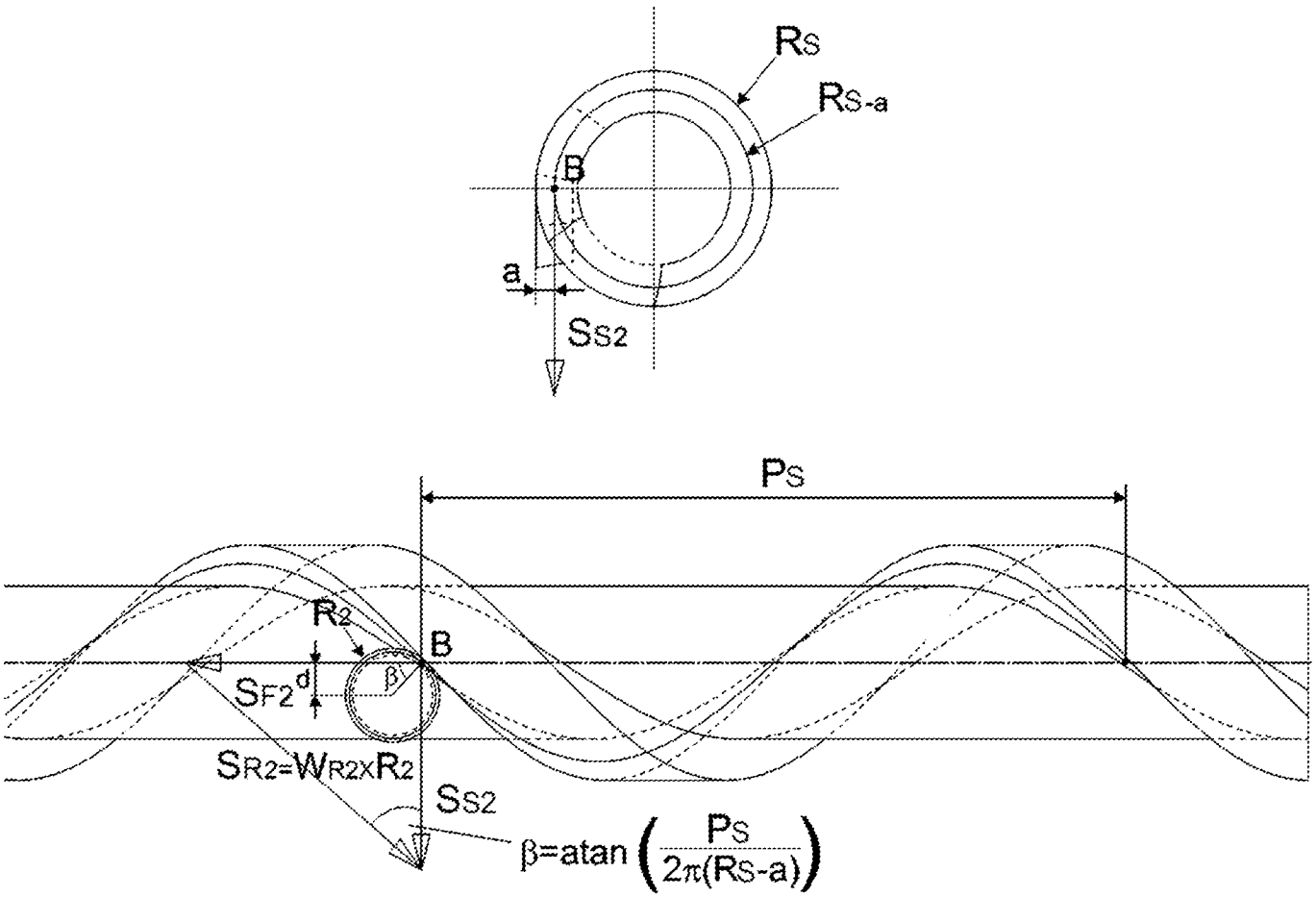
FIG. 6 is a side view of example contact between example drive rollers and example pulling helices in an inner area, with relative speeds deriving from the contact.

FIG. 5 provides a diagram of the starting position from which the geometry and the position of the drive roller 301 with a variable radius is determined, which enables motion to be transferred with complete engagement. For an outer radius Rs of the first helix 401, contained in a plane tangent to the outer cylinder of the screw 400, a circumference with a known radius R1 is placed. The axis that is perpendicular to the tangent plane and passes through the centre of the circumference is placed at a distance "d" from the axis of the screw 400. Distance is defined by the formula [$d=R1\times\sin\alpha$], where [$\alpha=\mathrm{atan}(Ps/(2\times\pi\times Rs))$], and where Ps is the pitch of the first helix 401 of the screw 400 in the drive zone. The axis that is perpendicular to the plane at a distance 'd' from the axis of the screw 400 defines the axis of the drive roller 301. With this condition, the speed of the screw, Ss1, at contact point A with the drive roller 301 is perpendicular to the axis of the screw 400, preventing friction in the contact caused by relative speed in the axial direction. The speed of point 'A' on the screw 400 may be broken down into two speeds, the forward-moving speed of the roller (Sf1) and the rotational speed tangent to the roller (Sr1). FIG. 6 provides a diagram of the process for defining the radius of the drive roller 301 in any plane parallel to the previous one by a known distance (a), the radius thus being defined as [$R2=\sin\beta$], were [$\beta=\mathrm{atan}\ (Ps/(2\times\pi\times(Rs-a)))$]. With this condition, the speed of the screw Ss2 at contact point B with the drive roller 301 is perpendicular to the axis of the screw 400, preventing the same problems as in the case of point 'A'.

Following the sequence of equations below, it is demonstrated that point A and point B have exactly the same forward-moving speed:

$Sf2=Ss2\times tg\beta\rightarrow$since [$\beta=\mathrm{atan}(Ps/(2\times\pi\times(Rs-a)))$] and [$Ss2=Ws\times(Rs-a)$] where $Ws$ is the rotational speed of the screw$\rightarrow Sf2=Ws\times(Rs-a)\times Ps/(2\times\pi\times(Rs-a))=Ws*Ps/(2\times\pi)=Sf$ $Sf1=Ss1\times tg\alpha\rightarrow$since [$\alpha=\mathrm{atan}(Ps/(2\times\pi\times Rs))$] and [$Ss1=Ws\times Rs$] where $Ws$ is the rotational speed of the screw$\rightarrow Sf1=Ws\times Rs\times Ps/(2\times\pi\times Rs)=Ws*Ps/(2\times\pi)=Sf$ Following the sequence of equations below, it is demonstrated that point A and point B generate exactly the same rotational speed in the roller (Wr):

$Sr2=Sf/\sin\beta=Sf/d\times R2$ $Sr1=Sf/\sin\beta=Sf/d\times R1$ $Sr2/Sr1=R2/R1\rightarrow Wr=Wr1=Wr2$, thereby demonstrating that there is no friction whatsoever produced in the contact between the helix and the drive roller.

What is claimed is:

1. A drive system for a transportation system, the drive system comprising:

an actuator configured to transmit an actuation motion from a motor;

a first pulling means configured to transmit a pulling motion from the actuator to moving parts of the transportation system in one or more transition speed sections located between a middle zone and at least one of an embarking zone or a disembarking zone of the transportation system; and a second pulling means configured to transmit a pulling motion from the first pulling means to the moving parts of the transportation system in a high speed section located in the middle zone of the transportation system, wherein the actuator comprises a screw having a constant pitch for use in the high speed section and a variable pitch for use in the one or more transition speed sections, wherein the screw comprises a first helix that engages with a first drive roller of the first pulling means to move the first pulling means, wherein the screw comprises a second helix that engages with a second drive roller of the first pulling means to stabilize the first pulling means relative to the screw.

2. The drive system of claim 1 wherein the first pulling means drives the second pulling means at least in the high speed section.

3. The drive system of claim 2 wherein an axis of the first drive roller of the first pulling means is positioned at a distance "d" from an axis of the screw such that d=R1×sin α, wherein R1 is a radius of the first drive roller in a plane perpendicular to the axis of the first drive roller and tangent to an outer radius of the screw of the actuator, wherein α=atan(Ps/(2×π×Rs)), wherein Ps is a pitch of the screw in the high speed section, wherein Rs is the outer radius of the screw, wherein radii of the first drive roller are at different distances "a" from planes perpendicular to their respective axes and tangent to the outer radius of the screw of the actuator, defined by $$R2=d/\sin\beta,$$

wherein β=atan(Ps/(2×π×(Rs−a))), and wherein a geometry of the second drive roller is based on a geometry of the first drive roller except that a position of an axis of the second drive roller is situated at a distance "d" from the axis of the screw opposite that of the first drive roller.

4. The drive system of claim 2 wherein the first pulling means is a carriage joined to a pallet that forms one of the moving parts of the transportation system.

5. The drive system of claim 2 wherein the first pulling means is a carriage joined to a grip that forms one of the moving parts of a variable speed continuous handrail of the transportation system, wherein the variable speed continuous handrail extends along both sides of the transportation system and is positioned at a higher elevation than pallets of the transportation system, wherein movement of the variable speed continuous handrail is synchronized with movement of the pallets of the transportation system.

6. A drive system for a transport system comprising:

actuation means for transmitting an actuation motion from at least one motor;

first pulling means configured to transmit a pulling motion from the actuation means to moving parts that form the transport system in a transition speed section situated between an embarking/disembarking zone and a middle zone, and in a high-speed section, to drive second pulling means configured to transmit a pulling motion from the first pulling means to the moving parts that form the transport system in a high-speed section situated in a middle zone of the transport system, wherein the actuation means comprise a screw having a constant pitch in the high-speed section a variable pitch in the transition speed zones, which transmits the motion of the first pulling means by means of a first helix that engages with a first drive roller of the first pulling means, with a variable radius, and prevents there being looseness between the two by means of a second helix that engages with a second drive roller of the first pulling means, with a variable radius.

7. The drive system of claim 6 wherein the axis of the first drive roller of the first pulling means is situated at a distance "d" from the axis of the screw, such that d=R1×sin α, wherein R1=radius of the first drive roller in a plane perpendicular to its axis and tangent to an outer radius of the screw, α=atan(Ps/(2×π×Rs)), Ps=pitch of the screw in the high-speed section, Rs=the outer radius of the screw, the radii of the first drive roller being at different distances "a" from the plane perpendicular to its axis and tangent to the outer radius of the screw, defined by $$R2=d/\sin\beta,$$

where β=atan (Ps/(2×π×(Rs−a))), the geometry of the second drive roller being generated in a manner analogous to that of the first drive roller but with a position of its axis situated at a distance "d" from the axis of the screw opposite that of the first drive roller.

8. The drive system of claim 6 wherein the first pulling means are carriages, each one of which is joined to a pallet that forms each one of the moving parts of the system, which in succession constitute a variable speed continuous passenger transport system.

9. The drive system of claim 6 wherein the first pulling means are carriages, each one of which is joined to a grip that forms each one of the moving parts of the system, which in succession constitute a variable speed continuous handrail placed on both sides and at a higher elevation of the variable speed continuous passenger transport system, providing a hold that is synchronized with the movement of the pallets.

* * * * *